United States Patent [19]

Bubik et al.

[11] 4,280,870

[45] Jul. 28, 1981

[54] PULP FEED FOR A PAPERMAKING MACHINE

[75] Inventors: Alfred Bubik, Ravensburg; Rüdiger Kurtz, Immenstaad, both of Fed. Rep. of Germany; Hermann Kutzelmann, Kriens, Switzerland

[73] Assignee: Escher Wyss GmbH, Ravensburg, Fed. Rep. of Germany

[21] Appl. No.: 187,602

[22] Filed: Sep. 15, 1980

Related U.S. Application Data

[63] Continuation of Ser. No. 38,625, May 14, 1979, abandoned.

[30] Foreign Application Priority Data

May 30, 1978 [CH] Switzerland ..... 5873/78

[51] Int. Cl.[3] ..... D21F 1/06

[52] U.S. Cl. ..... 162/336; 162/343; 162/344; 162/347

[58] Field of Search ..... 162/336, 216, 343, 44, 162/347

[56] References Cited

U.S. PATENT DOCUMENTS

| | | | |
|---|---|---|---|
| 3,309,264 | 3/1967 | Parker et al. | 162/343 |
| 4,021,296 | 3/1977 | Reiner | 162/344 |

FOREIGN PATENT DOCUMENTS

| | | | |
|---|---|---|---|
| 1120742 | 7/1968 | United Kingdom | 162/336 |

*Primary Examiner*—Peter Chin

*Attorney, Agent, or Firm*—Werner W. Kleeman

[57] ABSTRACT

A pulp feed for a papermaking machine, comprising a substantially slot-like guide channel having at least two step-like widened portions. Before and after each widened portion there is provided a linear channel section, and between the widened portions there is arranged a tapered section or portion. The slot widths before both of the widened portions can be of the same magnitude and conjointly adjustable by means of a translationally movable element. The slot-like guide channel has arranged forwardly thereof a perforated plate and a mixing chamber merging thereat. Also a pulp feed channel having an adjustable lip and merging at the guide channel can possess step-shaped widened portions.

9 Claims, 5 Drawing Figures

PULP FEED FOR A PAPERMAKING MACHINE

CROSS REFERENCE TO RELATED CASE

This is a continuation application of our commonly assigned U.S. application Ser. No. 38,625, filed May 14, 1979 now abandoned.

BACKGROUND OF THE INVENTION

The present invention relates to a new and improved construction of a pulp feed for a papermaking machine.

The pulp feed or headbox of the present invention is of the type comprising a guide device for the stock suspension or the like and which possesses an elongate slot-shaped guide channel. This guide channel is bounded in its lengthwise direction by side surfaces, wherein one of the side surfaces possesses at least two step-like widened portions, the other counter side surface is flat or planar at the region of the widened portions and therebetween. Forwardly of each widened portion and after the same there is arranged a respective surface section or portion merging therewith, which is likewise flat and parallel to the flat or planar counter surface.

A pulp feed of this type is known to the art for instance from FIG. 6 of the German Pat. No. 1,220,247. With this state-of-the-art equipment the step-like widened portions serve for the formation of micro-turbulence in the stock suspension, producing a uniform distribution of the fibers within the suspension.

SUMMARY OF THE INVENTION

It is a primary object of the present invention to provide a new and improved construction of a pulp feed affording an extremely uniform distribution of the fibers within the suspension.

Another and more specific object of the invention is to improve upon the above-mentioned prior art equipment, with the view of enhancing the strived for micro-turbulence in a manner such that there can be also processed stock suspensions of higher consistency, i.e., containing a smaller amount of water.

Yet a further significant object of the invention is to provide a new and improved construction of pulp feed which is relatively insensitive to clogging and enables processing unsorted waste paper into paperboard or cardboard and so forth.

Now in order to implement these and still further objects of the invention, which will become more readily apparent as the description proceeds, the invention contemplates having a tapered channel section merging with the flat section or portion following the first step-shaped widened portion, as viewed with respect to the direction of flow of the stock suspension. The boundary surface of the channel section encloses an angle with respect to the counter surface which does not exceed 90°, preferably is less than 45°.

Moreover, the length of the flat section or portion, which merges with the first step-like or step-shaped widened portion, can preferably amount to at least six-fold of its height. In this way there is rendered possible a uniform spreading or propagation of the micro-turbulence formed at the step-like widened portion over the entire cross-section.

The length of the flat section, at which merges the second step-shaped widened portion, can amount to at least two-fold the gap width of the guide channel at this location. Also in this case there is obtained a spreading or propagation of the micro-turbulence which is formed at the transition beween the inclined surface section and the parallel section over the entire flow cross-section.

Moreover, the flat surface sections located in front of both widened portions preferably can be disposed in the same plane in such a manner that together with the counter surface they form essentially the same gap widths. Due to these measures there is achieved the same flow velocity at the narrowest locations of the guide channel, namely forwardly of the widened portions. This affords the advantage that the ratio between the largest and smallest flow velocity in the guide channel is smaller, so that if, for instance, a certain velocity should not be exceeded at the outlet in order to prevent flocculation, the flow velocity at the inlet does not become too large.

Preferably, one of the surfaces bounding the guide channel can be translatorily adjusted in relation to the other and essentially perpendicular thereto, e.g. the flat counter surface. In this way there can be achieved an accommodation of the flow velocities in the guide device to a given throughput of the stock suspension, and thus, there can be obtained an optimum mode of operation of the pulp feed.

Furthermore, the slot-like guide channel can have arranged forwardly thereof a perforated plate possessing cylindrical distributor bores and a mixing chamber merging thereat, the mixing chamber having a cross-section which is enlarged in relation to the inlet of the guide channel. In known manner, the perforated plate allows for a uniform distribution of the stock suspension which is infed from a distributor tube or pipe, over the width of the papermaking machine, i.e., the length of the slot-shaped guide channel. The mixing chamber, in turn, produces a uniform distribution of the stock suspension flowong out of the bores of the perforated plate over the width of the sections of the guide channel between the individual bores.

With such type constructed equipment the openings or bores of the perforated plate can be arranged at a spacing amounting to at least 100 mm from one another. In this way there is beneficially avoided any clogging of the distributor bores by coarser constituents of the stock suspension, such as typically for instance cords or the like.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
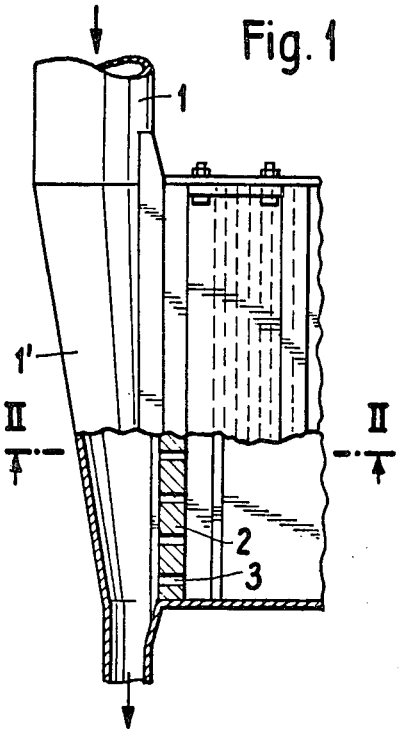
FIG. 1 is a plan view, partially in section, of a pulp feed or headbox according to the invention.
Figure 2:
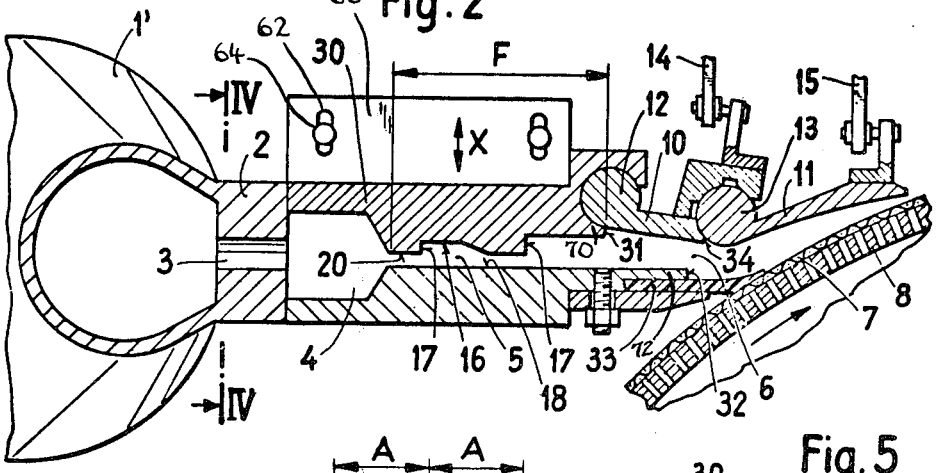
FIG. 2 is an enlarged sectional view of the arrangement of FIG. 1, taken essentially along the line II—II thereof.

Describing now the drawings, the exemplary embodiment of pulp feed or headbox arrangement illustrated in FIGS. 1 and 2, will be seen to comprise a distributor tube or pipe 1 having a conical section or portion 1' at which laterally merges a perforated plate 2 containing essentially cylindrical bores or openings 3. Viewed in the direction of flow of the stock suspension there is arranged a mixing chamber or compartment 4 after the perforated plate 2. This mixing chamber 4 extends over the entire width of the apparatus. The stock suspension or the like arrives from the mixing chamber 4 at a guide channel 5, the principal portion of which essentially extends over the length F as shown in FIG. 2. According to such FIG. 2, there will be further seen that a pulp feed channel 6 merges with the guide channel 5, this pulp feed channel 6 opening at a perforated element, here shown in the form of a sieve or screen 7 guided over a perforated sieve cylinder 8. The pulp feed channel 6 is provided with an adjustable lip arrangement 10, 11 for adjusting its cross-section, this lip arrangement or lip means consisting of the adjustable lip elements 10 and 11. These lip elements 10 and 11 are pivotably arranged, in known manner, about essentially cylindrical portions 12 and 13 and can be adjusted with the aid of the rods 14 and 15 or equivalent structure, leading to not particularly illustrated, but conventional adjustment mechanisms. While different types of adjustment mechanisms for the lip elements 10 and 11 can be provided, one suitable construction has been disclosed in the commonly assigned U.S. Pat. No. 3,909,349, granted Sept. 30, 1975 to which reference may be readily had, and the disclosure of which is incorporated herein by reference.

Figure 3:
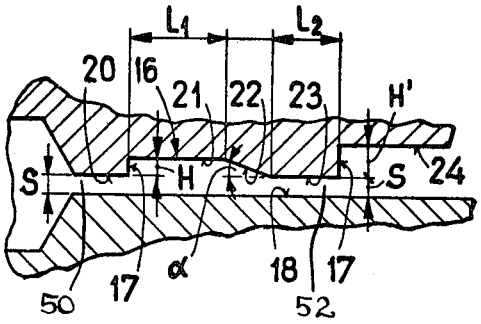
FIG. 3 is a detailed sectional view, again on an enlarged scale, of the arrangement of FIG. 2, illustrating the guide channel.

As best seen by referring to FIGS. 2 and 3, the pulp feed contains a preferably displaceable element or wall 30 having a side surface 16 which bounds the slot-shaped guide channel 5 and this side surface 16 is provided with two step-shaped widened portions 17 located opposite a flat or planar side surface 18. Forwardly or upstream of the first widened portion 17 there is located a flat section or portion 20 of the upper side surface 16, and following such a section or portion 21. This first step-shaped widened portion 17 has a height H. Between the surfaces 18 and 20 there is formed a gap 50 having the gap width S.

The surface section 21 extends in the direction of flow of the stock suspension or the like along a length $L_1$, amounting to at least six times the height H. Merging with the flat section or portion 21 is a tapered surface portion 22, forming a constriction or tapering of the guide channel 5, and whose angle $\alpha$ with respect to the surface 18 and the surface 21 at most amounts to 90°, preferably is less than 45°. Merging with the surface 22 is a flat section or surface 23 which is likewise essentially parallel to the surface 18 and forms therewith the same gap width S as the surface section or portion 20. After the widened portion 17 there is finally arranged a flat section or portion 24 which is parallel to the surface 18 and which extends up to the end of the guide channel 5, i.e., up to the lip element or part 10. The section 23 has a length $L_2$ amounting to at least twice the gap width S. The length of the section or portion 24 amounts to at least six times the step height H'.

Figure 4:
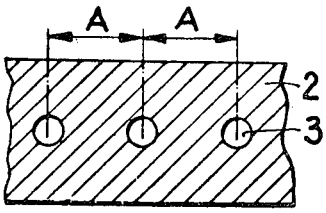
FIG. 4 is a cross-sectional view of FIG. 2, taken substantially along the line IV—IV thereof.

FIG. 4 illustrates in section the perforated plate 2 according to the section line IV—IV of FIG. 2. It will be seen that the bores or openings 3 of this perforated plate 2 are spaced at a distance A from one another. This spacing A between each two neighboring bores 3 can amount to at least 50 mm, preferably amounts to more than 80 mm.

Figure 5:
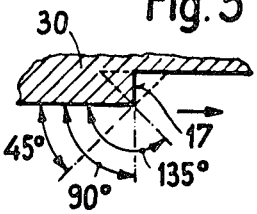
FIG. 5 is a detailed showing of the step-shaped widened portion of the arrangement of FIG. 3.

FIG. 5 illustrates in cross-section a step-shaped widened portion 17, there being shown in broken lines the boundaries of the inclination angle of such widened portion. In accordance with FIG. 5 this angle can be in a range of about 45° to 135°.

As also seen by referring to FIG. 2, the step-shaped widened portions 17 of the guide channel 5 are formed at the wall element 30 which, as indicated by the double-headed arrow X, can be translatorily adjusted perpendicular to the surface 18. This is possible, for instance, by affixing the element 30 to an adjustment plate 60 having the elongate opening 62 with which engage the fixing bolts 64 or equivalent structure. Hence, it should be evident it is possible to selectively adjust the size of both of the gaps 50 and 52 (FIG. 3) of the width S. Obviously, other constructions of adjustment mechanisms for the element 30 are possible.

As equally evident by referring to FIG. 2, the pulp feed channel 6 is also equipped with step-shaped widened portions, such as the widened portions 31, 32 and 34 to be discussed shortly hereinafter, these widened portions being arranged at suitable locations and ensuring for maintenance of the micro-turbulence of the flow of the stock suspension.

More specifically, with the arrangement of FIG. 2 the bearing or support means 70 for the substantially cylindrical hinge portion or element 12 is provided with such type widened portion 31. A further widened portion 32 is formed by a plate 72 serving for attachment of an elastic sealing lip 33. Finally, also the end of the lip 33 can be structured so as to form a widened portion 34.

During operation, stock suspension or the like is delivered by the tube or pipe 1 to the pulp feed or headbox arrangement. The bores or openings 3 of the perforated plate 2 ensure for an essentially uniform distribution of the stock suspension over the width of the papermaking machine, i.e., throughout the length of the guide channel 5. The spacing A of these bores or openings 3 is chosen such that also parts contained in unsorted waste paper, such as for instance cords of a certain length, do not clog these bores or openings 3. The danger of clogging always then exists when a cord or an elongate contaminant has its ends inserted into two neighboring bores or openings 3. For the same reason also the guide channel 5, in the form of an elongate or lengthwise extending gap, is extensively insensitive to clogging.

The mixing chamber 4 is assigned the task of combining with one another the jets of stock suspension emanating from the relatively widely spaced bores or openings 3 in a manner such that the stock suspension is essentially uniformly distributed at the guide channel 5. The tapered structure of the guide channel 5 which is provided by the tapered surface 22 likewise is favorable in this regard, since also this surface 22 causes uniform distribution of the flow throughout the cross-section of the papermaking machine. Between the widened portions 17 there is likewise formed by the tapered surface 22 a not particularly referenced chamber which functions similar to the mixing chamber or compartment 4.

As will be apparent from the disclosure, by virtue of the individual features of the described pulp feed there are afforded particular advantages, such as for instance improved micro-turbulence of the stock suspension, adjustability of the flow velocity at the narrowest location of the guide channel, so that it is possible to use stock suspensions having a greater consistency than was heretofore possible. By virtue of the aggregate of the features there is additionally obtained, on the other hand a pulp feed which is extensively insensitive to clogging phenomenon and is extremely suitable for the fabrication of paper, especially cardboard or paperboard from unsorted waste paper.

While there are shown and described present preferred embodiments of the invention, it is to be distinctly understood that the invention is not limited thereto, but may be otherwise variously embodied and practiced within the scope of the following claims Accordingly,

What we claim is:

1. A pulp feed for feeding pulp from a headbox into a forming screen of a papermaking machine containing a guide device for a stock suspension, said guide device comprising:

an elongate, substantially slot-shaped guide channel means having a predetermined lengthwise direction of extent;

said guide channel means being bounded by side surfaces;

one of said side surfaces having two substantially step-shaped widened portions;

the other of said side surfaces being essentially flat at the region of the widened portions and between said widened portions;

the other of said side surfaces defining a substantially flat counter surface;

the one of said side surfaces having, before and after each widened portion, a respective surface section merging therewith;

each said surface section being essentially flat and extending essentially parallel to said flat counter surface;

said step-shaped widened portions defining a first widened portion and a second widened portion spaced from one another in the direction of flow of the stock suspension;

a tapered channel section merging with the flat surface section following the first step-shaped widened portion in the direction of flow of the stock suspension;

said tapered channel section having a boundary surface enclosing an angle which does not exceed 45° with respect to the flat counter surface;

a perforated plate, having substantially cylindrical bores, being connected forwardly of said slot-shaped guide channel means;

a mixing chamber being connected after said perforated plate and having an enlarged cross-sectional area in relation to a starting region of said guide channel means; and the length of the flat section following the first step-shaped widened portion amounts to at least six times the height of said first step-shaped widened portion.

2. A pulp feed for feeding pulp from a headbox onto a forming screen of a papermaking machine containing a guide device for a stock suspension, said guide device comprising:

an elongate, substantially slot-shaped guide channel means having a lengthwise direction of extent;

said guide channel means being bounded by side surfaces;

one of said side surfaces having two substantially step-shaped widened portions;

the other of said side surfaces being essentially flat at the region of the widened portions and between said widened portions;

the other of said side surfaces defining a substantially flat counter surface;

the one of said side surfaces having, before and after each widened portion, a respective surface section merging therewith;

each said surface section being essentially flat and extending essentially parrallel to said flat counter surface;

said step-shaped widened portions defining a first widened portion and a second widened portion spaced from one another in the direction of flow of the stock suspension;

a tapered channel section merging with the flat surface section following the first step-shaped widened portion in the direction of flow of the stock suspension;

said tapered channel section having a boundary surface enclosing an angle which does not exceed 45° with respect to the flat counter surface;

a perforated plate, having substantially cylindrical bores, being connected forwardly of said slot-shaped guide channel means;

a mixing chamber being connected after said perforated plate and having an enlarged cross-sectional area in relation to a starting region of said guide channel means; and the flat surface section directly forwardly of the second step-shaped widened portion having a length amounting to at least twice the gap width of the guide channel means at such location.

3. The pulp feed as defined in claim 1 or 2 wherein:

the flat surface sections located in front of both step-shaped widened portions are located essentially in the same plane in a manner such that they form essentially the same gap widths with the counter surface.

4. The pulp feed as defined in claim 1 or 2, further including:

means for translatorily displacing one of the side surfaces of the guide channel means in relation to the other side surface and essentially perpendicular to the flat counter surface.

5. The pulp feed as defined in claim 1 or 2, wherein:

said bores of said perforated plate are arranged in spaced relationship from one another at a spacing amounting to at least 50 mm between each two adjacent bores.

6. The pulp feed as defined in claim 5, wherein:

said spacing amounts to more than 80 mm.

7. The pulp feed as defined in claim 1 or 2, further including:

pulp feed channel means connected with said guide channel means;

sieve means with which cooperate said pulp feed channel means;

said pulp feed channel means being provided with at least one adjustable lip for adjusting the cross-sectional area of said pulp feed channel means.

8. The pulp feed as defined in claim 7, wherein:

said pulp feed channel means is structured to provide at least one step-shaped widened portion.

9. The pulp feed as defined in claim 1, wherein:

the flat surface section directly forwardly of the second step-shaped widened portion having a length amounting to at least twice the gap width of the guide channel means at such location.

* * * * *